US011056780B2

(12) United States Patent
Polehn et al.

(10) Patent No.: US 11,056,780 B2
(45) Date of Patent: Jul. 6, 2021

(54) WINDOW-MOUNTED ANTENNA UNIT

(71) Applicant: Verizon Patent and Licensing Inc., Arlington, VA (US)

(72) Inventors: Donna L. Polehn, Bellevue, WA (US); Fred Weisbrod, Renton, WA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 93 days.

(21) Appl. No.: 15/825,236

(22) Filed: Nov. 29, 2017

(65) Prior Publication Data

US 2019/0165448 A1 May 30, 2019

(51) Int. Cl.

| | |
|---|---|
| ***H01Q 23/00*** | (2006.01) |
| ***H01Q 1/44*** | (2006.01) |
| ***H01Q 5/22*** | (2015.01) |
| ***H01Q 1/12*** | (2006.01) |
| *H01Q 3/26* | (2006.01) |

(52) U.S. Cl.

CPC ..... *H01Q 1/44* (2013.01); *H01Q 1/1221* (2013.01); *H01Q 5/22* (2015.01); *H01Q 23/00* (2013.01); *H01Q 3/26* (2013.01)

(58) Field of Classification Search

CPC ..... H01Q 1/12; H01Q 1/1221; H01Q 1/125; H01Q 1/22; H01Q 1/24; H01Q 1/246; H01Q 1/44; H01Q 5/22; H01Q 3/26; H01Q 23/00; H02J 50/005; H02J 50/40; H02J 50/402; H02J 5/00; H02J 5/005

See application file for complete search history.

(56) References Cited

U.S. PATENT DOCUMENTS

| | | | | |
|---|---|---|---|---|
| 10,014,948 | B2 * | 7/2018 | Ashrafi | H04L 27/38 |
| 10,326,519 | B2 * | 6/2019 | Khan | H04B 7/15507 |
| 2019/0140732 | A1 * | 5/2019 | Shahramian | H04B 5/0031 |

* cited by examiner

*Primary Examiner* — Dimary S Lopez Cruz
*Assistant Examiner* — Patrick R Holecek

(57) ABSTRACT

An RF antenna system includes a first unit that further includes first attachment means that secures the first unit to a window, and an antenna. The first unit additionally includes an RF transceiver, coupled to the antenna, that receives, via the antenna, incoming RF signals and converts the RF signals to first electrical signals; and first optical means that transmits the first electrical signals as first optical signals through the first surface of the window. The RF antenna system also includes a second unit that includes second attachment means that secures the second unit to the window. The second unit also includes second optical means that receive the first optical signals through the second surface of the window, convert the first optical signals to first digital signals, and transmit the first digital signals to a device connected to the second unit.

20 Claims, 8 Drawing Sheets

WINDOW-MOUNTED ANTENNA UNIT

BACKGROUND

Next Generation wireless systems are expected to operate in the higher frequency ranges, and such systems are expected to transmit and receive in the GigaHertz band, alternatively known as the millimeter wave spectrum, with a broad bandwidth near 500-1,000 MegaHertz. The expected bandwidth of Next Generation wireless systems is intended to support download speeds of up to about 35-50 Gigabits per second. Next Generation wireless systems, such as Fifth Generation (5G) systems, are expected to enable a higher utilization capacity than current wireless systems, permitting a greater density of wireless users, with a lower latency.

DETAILED DESCRIPTION OF THE PREFERRED EMBODIMENTS

Figure 1:
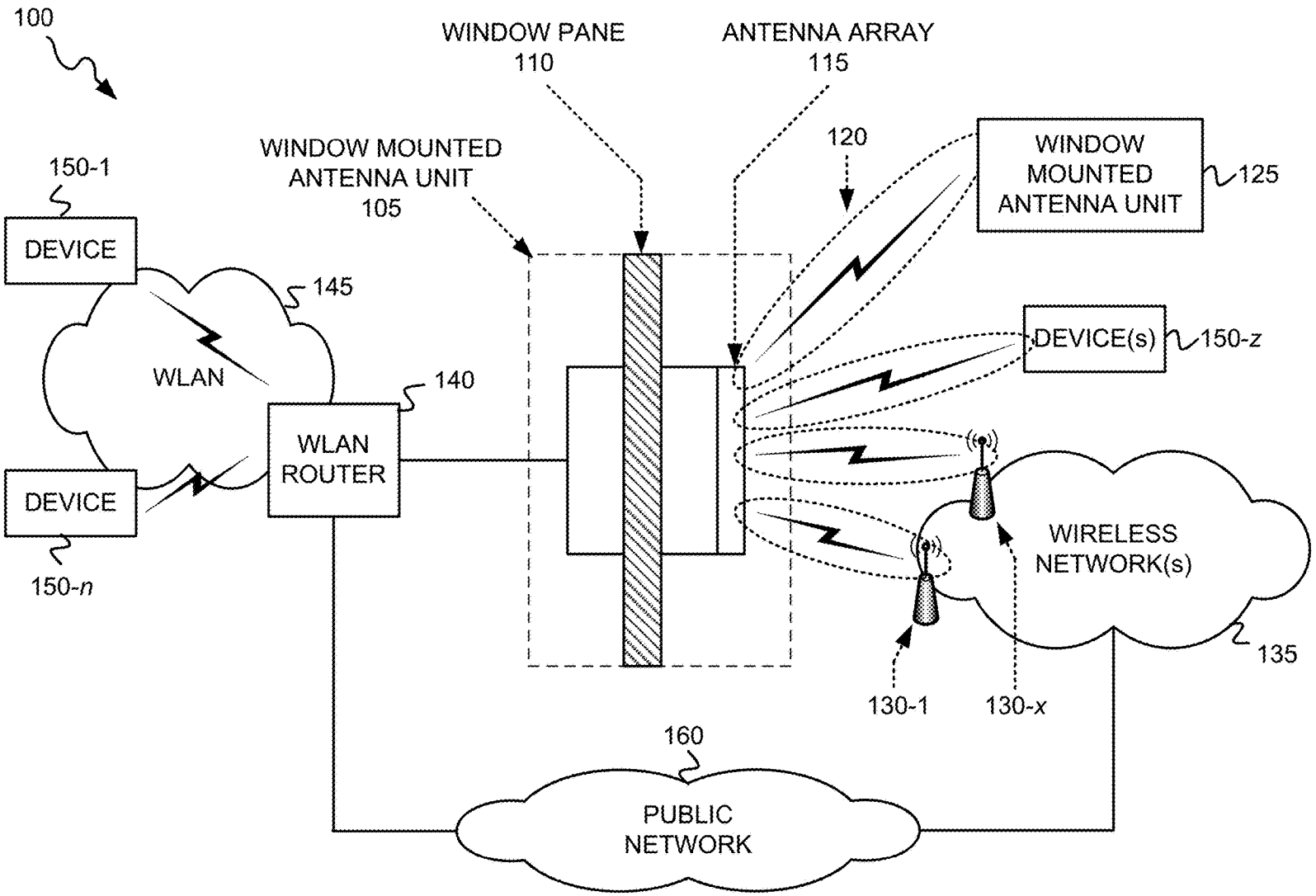
FIG. 1 illustrates an overview of an exemplary network environment in which a window-mounted antenna and transceiver unit attaches to a window of a building and transmits and receives radio frequency signals via an antenna array of the window-mounted antenna and transceiver unit.

The following detailed description refers to the accompanying drawings. The same reference numbers in different drawings may identify the same or similar elements. The following detailed description does not limit the invention, which is defined by the claims.

Millimeter wave (mmWave) frequencies (e.g., 14 GigaHertz (GHz) or higher) are proposed to be used in advanced wireless systems, such as, for example, 5G wireless systems. mmWave frequencies, however, have limited building penetration. Due to this limited building penetration, the cell sites containing the system antennas will need to be close to the network user to make up for the losses through the building. This requires a greater cell density in the advanced wireless systems, relative to current systems. Additionally, to satisfy the improved utilization capacity requirements of advanced wireless systems, a greatly increased number of antennas, relative to current systems (e.g., Fourth Generation (4G) systems), will need to be deployed to support high bandwidth connections to each wireless device. In current wireless systems, the typical distance between adjacent antennas is about 1.5-3.2 kilometers (km). In contrast, for proposed advanced wireless systems, such as 5G systems, the distance between adjacent antennas may need to be reduced to about 200-300 meters. Therefore, next generation wireless systems may need as many as one hundred times the number of antennas as compared to current wireless systems.

Furthermore, the current technology for installation of outside antennas for cell sites in the vicinity of buildings requires, for example, drilling through building walls, and/or other disruptive, time consuming, or expensive installation activities. Modern windows in buildings, additionally, often have metallic type coatings to aid in thermal transfer characteristics (i.e., to reflect infrared radiation but let light through). These same coatings significantly attenuate radio frequency (RF) signals, thereby, limiting the range of cell sites located in or near such buildings.

Exemplary embodiments described herein relate to an RF antenna assembly that may be mounted on windows of a building and used to set up additional cells, or extend the range of existing cells, for transmitting and/or receiving RF signals within the wireless network. The RF antenna assembly may include an outdoor unit that attaches to an exterior surface of a window of a building, and an indoor unit that attaches to an interior surface of the window, where the outdoor unit is aligned with the indoor unit through the window. The RF antenna assembly may be easily installed, requiring no tools or alterations to the building. The outdoor unit includes an antenna, such as, for example, a phased array antenna, that transmits RF signals to, and receives RF signals from, other nodes in the wireless network (e.g., from cell phones, or base stations) and may, therefore, act as a micro-cell site in a cellular network. The RF signals received at the phased array antenna are converted by the outdoor unit into, for example, optical signals, and transmitted through the window. The indoor unit of the RF antenna assembly receives the optical signals transmitted by the outdoor unit through the window, and converts the optical signals to digital signals that can then be transmitted on to one or more additional nodes or devices, such as, for example, to a router. Additionally, the indoor unit may include wireless power transfer circuitry that wirelessly transfers power from the indoor unit to the outdoor unit to power the components of the outdoor unit.

The RF antenna assembly described herein, therefore, permits the creation of additional cell sites, or extends the range of existing cell sites, within a wireless network through the placement of one or more RF antenna assemblies at windows within one or more buildings within a geographic area. The RF antenna assembly, thus, may enable an increase in cell site density so as improve signal strength and bandwidth within the wireless network without having to incur disruptive, time consuming, and/or expensive cell site installation activities. Additionally, if used to extend the range of existing cell sites, the RF antenna assembly can increase cell spacing, thereby reducing the amount of needed cell site infrastructure (e.g., fewer base stations).

FIG. 1 illustrates an overview of an exemplary network environment 100 in which a window-mounted antenna and transceiver unit 105 (referred to herein as "antenna unit 105" or "antenna assembly system 105") is attached to a window 110 of a building (not shown) for transmitting and receiving RF signals via an antenna array 115 of the window-mounted antenna unit 105. As referred to herein, "attach," "attached," or "attachment" means to affix, connect, couple, clamp, and/or brace antenna unit 105 to window 110 in any manner that causes antenna unit 105 to be secured in place against a surface of window 110. As shown, the window-mounted antenna unit 105 is attached to an inside surface of the window 110 and to an outside surface of the window 110. Window 110 may be composed of a material (e.g., glass) that is transparent to particular wavelengths (e.g., optical). The antenna array 115 of the antenna unit 105 may establish one or more "cells" 120 with at least one other window-mounted antenna unit 125, one or more wireless stations 130-1 through **130-*x* (e.g., base stations, eNodeBs, etc.) of one or more wireless network(s) 135, and/or one or more devices 150-*z*. The antenna array 115 of the antenna unit 105 may transmit RF signals to, and/or receive RF signals from, window-mounted antenna unit 125, wireless stations 130-1 through 130-*x* of wireless network(s) 135, and/or device(s) 150-*z*. Each cell 120 associated with antenna array 115 may cover a spatial area defined by the characteristics of the one or more antennas of the antenna array 115. The antenna array 115 may include, for example, a phased array antenna or a waveguide planar antenna that further includes an array of numerous antenna elements for transmitting and receiving radio frequency (RF) signals in the mmWave spectrum. Other types of antennas or antenna arrays, however, may alternatively be used in window-mounted antenna unit 105**.

Wireless network(s) 135 may include, for example, one or more public land mobile networks (PLMNs) (e.g., a Code Division Multiple Access (CDMA) 2000 PLMN, a Global System for Mobile Communications (GSM) PLMN, a Long Term Evolution (LTE) PLMN and/or other type of PLMN), one or more satellite mobile networks, and/or one or more other types of wireless networks (e.g., wireless Local Area Networks (WLANs)).

As further shown in FIG. 1, antenna unit 105 may connect to a WLAN router 140 (herein referred to as "router 140") via either a wired or wireless link and to a public network 160 via either a wired or wireless link. In one embodiment, router 140 may be incorporated directly into antenna unit 105. In additional implementations, antenna unit 105 may include a wireless transceiver for establishing a wireless Local Area Network (WLAN) or Personal Area Network (PAN) with router 140, or other node or device, for transmitting data to, and receiving data from, router 140 or the other node or device. The PAN may employ a short distance wireless technology such as, for example, Insteon, Infrared Data Association (IrDA), Wireless Universal Serial Bus (USB), Bluetooth, Z-Wave, Zigbee, and/or Body Area Network. WLAN router 140, or antenna unit 105, may establish a wireless LAN 145 with devices 150-1 through **150-*n*. The WLAN may include, for example, a wireless network that uses the IEEE 802.11 standard (e.g., Wi-Fi). Other wireless LAN standards may, however, be used. Alternatively, or additionally, router 140 may establish a wired LAN to which one or more of devices 150 connect via a wired link. Router 140 includes a routing device that routes data to/from devices 150 either via window-mounted antenna unit 105 or via public network 160. Router 140 may reside at a home, office, or any other type of building that includes window 110**.

Devices 150-1 through **150-*n*, and device(s) 150-*z* (referred to herein as "device 150" or "devices 150"), may each include any type of wired or wireless communication device that transmits and/or receives data via WLAN 145 (or a wired network not shown) and router 140, or via antenna array 115 of window-mounted antenna unit 105. For example, devices 150 may each include a cellular telephone (e.g., a "smart" phone), a computer (e.g., desktop, laptop, palmtop, tablet, or wearable), a set-top box (STB), a media player, a gaming device, or an Internet of Things (IoT) or Machine-to-Machine (M2M) device. A "user" (not shown in FIG. 1) may be associated with each device 150. Each "user" may be an owner, operator, and/or a permanent or temporary user of the device 150. Devices 150** may each include an RF communication interface (e.g., a mmWave RF interface), a Wi-Fi communication interface, and/or a wireless Personal Area Network (PAN) communication interface (e.g., Bluetooth™).

Public network 160 may include, for example, one or more telecommunications networks (e.g., Public Switched Telephone Networks (PSTNs)), wired and/or wireless LANs, wired and/or wireless wide area networks (WANs), metropolitan area networks (MANs), an intranet, or the Internet. As shown, public network 160 may connect to router 140 and to wireless network(s) 135.

The configuration of network environment 100 depicted in FIG. 1 is for illustrative purposes, and other configurations may be implemented. Therefore, network environment 100 may include additional, fewer, and/or different components or devices, that may be configured or connected differently, than depicted in FIG. 1. For example, though a single window-mounted antenna unit 105 and window 110 is shown in FIG. 1, network environment 100 may include numerous different window mounted antenna units 105, each attached to a respective window 110 of one or more different buildings, and coupled to a respective router 140, or other node or device.

Figure 2:
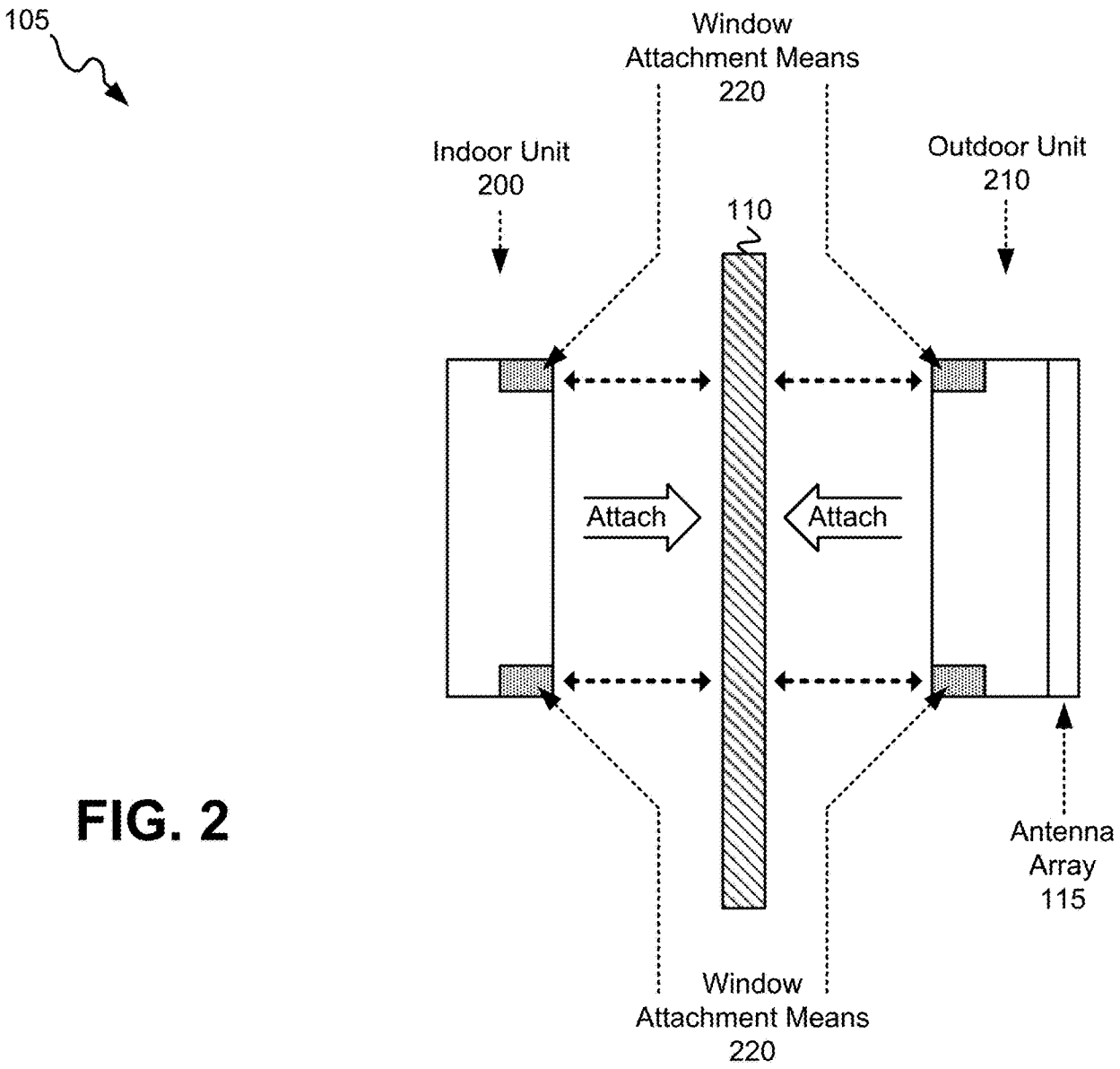
FIG. 2 depicts further details of the attachment of the window-mounted antenna unit of FIG. 1 to the building window.

FIG. 2 depicts further details of the attachment of window-mounted antenna unit 105 to window 110. As shown, antenna unit 105 includes an indoor unit 200 and an outdoor unit 210. Indoor unit 200 attaches to an inner surface of window 110, and outdoor unit 210 attaches to an outer surface of window 110. Indoor unit 200 and outdoor unit 210 attach to window 110 using window attachment means 220. In one implementation, each of the window attachment means 220 includes a permanent magnet, such as, for example, a neodymium magnet that exhibits a very strong attractive magnetic force to other neodymium magnets. In another implementation, the magnet may be an electromagnet powered by a power supply. In other implementations, each of window attachment means 220 includes a suction cup that sticks to the smooth surface of window 110, or includes various types of adhesive that may be applied to portions of a surface of indoor unit 200 and/or outdoor unit 210. Once the adhesive is applied to the portions of the surface of indoor unit 200 and/or outdoor unit 210, indoor unit 200 may be attached (i.e., "stuck") to an inner surface of window 110, and outdoor unit 210 may be attached (i.e., "stuck") to an outer surface of window 110, such that indoor unit 200 and outdoor unit 210 are aligned with one another, as described further below. Additionally and/or alternatively, window attachment means 220 may attach indoor unit 200 and/or outdoor unit 210 using a positioning/holding fixture that fixes indoor unit 200 and/or outdoor unit 210 to window 110.

Figure 3:
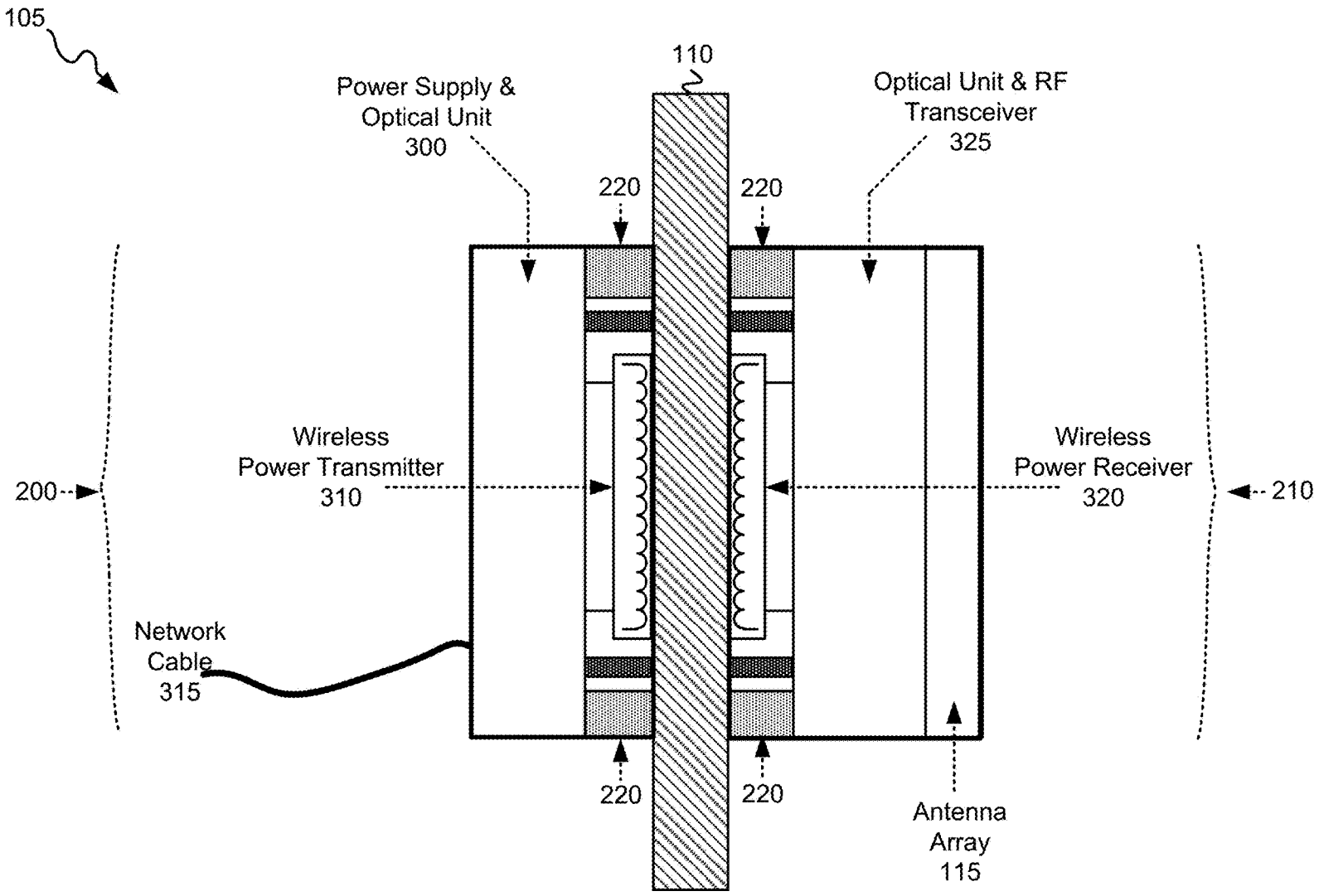
FIG. 3 depicts further details of internal components of an indoor unit and an outdoor unit of the window-mounted antenna unit of FIG. 1.

FIG. 3 depicts further exemplary details of internal components of indoor unit 200 and outdoor unit 210 of window-mounted antenna unit 105. Indoor unit 200, as shown, includes a power supply and an optical unit 300, a wireless power transmitter 310, and a network cable 315. Outdoor unit 210, as further shown, includes a wireless power receiver 320, and an optical unit and RF transceiver 325.

Power supply and optical unit 300 of indoor unit 200 may receive alternating current (AC) power from an external power source (not shown) and supply at least a portion of the received AC power to wireless power transmitter 310 which, in turn, wirelessly transfers the power through window 110 to outdoor unit 210. Power supply and optical unit 300 of indoor unit 200 additionally receives optical signals transmitted from outdoor unit 210 through window 110 to indoor unit 200, converts the optical signals to digital signals, and sends the digital signals via wired or wireless link to router 140, or to another node or device. If indoor unit 200 connects to router 140, or another node(s) or device(s), via a wired link, a network cable 315 may connect to a port in indoor unit 200 that facilitates the transmission of signals to, and reception from, router 140, or the other node(s) or device(s) (e.g., hub, switch, etc.), connected to the port via the network cable 315. Power supply and optical unit 300 of indoor unit 200 further receives digital signals via the wired or wireless link, from router 140, or the other node(s) or device(s), and converts the digital signals to optical signals, and transmits the optical signals through window 110 to outdoor unit 210.

Wireless power receiver 320 of outdoor unit 210 receives the power wirelessly transferred through window 110 from wireless power transmitter 310 of indoor unit 200. Wireless power receiver 320 supplies the received power to the other components of outdoor unit 210 to enable powered operation. Optical unit and RF transceiver 325 of outdoor unit 210 receives optical signals transmitted from indoor unit 200 through window 110 to outdoor unit 210, converts the optical signals to electrical signals, and transmits the electrical signals as RF signals via antenna array 115. Optical unit and RF transceiver 325 of outdoor unit 210 additionally receives RF signals, via antenna array 115, converts the corresponding electrical signals to digital signals, and transmits the digital signals as optical signals through window 110 to indoor unit 200.

Figure 4B:
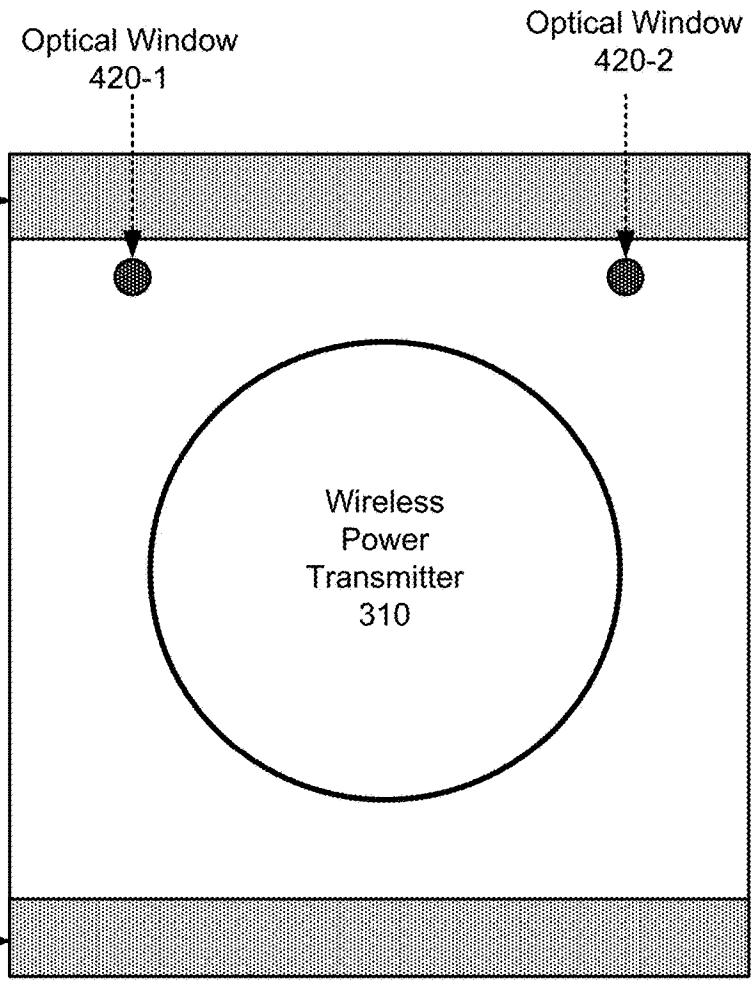
FIGS. 4A and 4B depict a side view and a front view of the indoor unit of the window-mounted antenna unit.
Figure 4A:
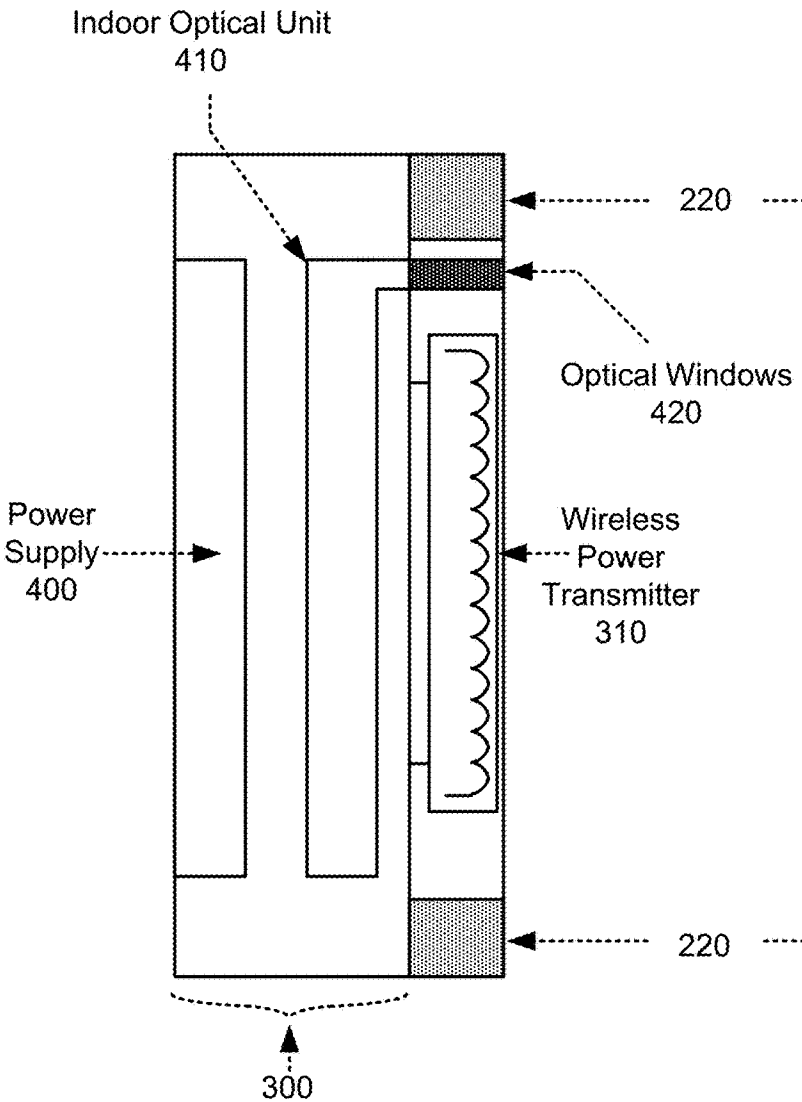

FIGS. 4A and 4B depict a side view and a front view, respectively, of indoor unit 200 of window-mounted antenna unit 105. As shown in the side view of FIG. 4A, indoor unit 200 includes a power supply 400, an indoor optical unit 410, and optical windows 420. Power supply 400 receives power from an external power source (not shown), supplies a first portion of the received power (e.g., AC power) to wireless power transmitter 310 for wireless transfer to outdoor unit 210 through window 110, and converts a second portion of the received power to direct current (DC) power for powering the components of indoor unit 200.

Indoor optical unit 410 of indoor unit 200 additionally receives optical signals transmitted from outdoor unit 210 through window 110 and a respective one of optical windows 420, converts the optical signals to digital signals, and sends the digital signals via a wired or wireless link to router 140 (not shown), or to another node(s) or device(s). Indoor optical unit 410 of indoor unit 200 further receives digital signals via the wired or wireless link from router 140 (not shown), or from the other node(s) or device(s), converts the digital signals to optical signals, and transmits the optical signals through a respective one of optical windows 420 and through window 110 to outdoor unit 210.

As shown in the front view of FIG. 4B, wireless power transmitter 310 may be disposed centrally within a face of antenna unit 105 such that a large surface area of wireless power transmitter 310 faces the wireless power receiver 320 of outdoor unit 210 (not shown). Optical window 420-1 and optical window 420-2 each include an optical conduit (e.g., optically transmissive) from indoor optical unit 410 through to the outer surface of the front of indoor unit 200 shown in FIG. 4B. Optical window 420-1 includes an optical conduit from the optical data transmitter (not shown) of indoor optical unit 410 to the outer surface of indoor unit 200. The optical data transmitter (not shown) of indoor optical unit 410, therefore, transmits optical signals through optical window 420-1 and window 110 to a corresponding optical window disposed within the outdoor unit 210 (not shown). Optical window 420-1 includes an optical conduit from the outer surface of indoor unit 200 to the optical data receiver (not shown) of indoor optical unit 400. The optical data receiver (not shown) of indoor optical unit 410, therefore, receives optical signals transmitted from outdoor unit 210 through window 110 and optical window 420-2. In one implementation, optical windows 420-1 and 420-2 each include optically translucent or transparent sections of the housing of indoor unit 200. In another implementation, optical windows 420-1 and 420-2 each include a hole, or gap, in the housing of indoor unit 200, such that the housing may be open to the exterior, which permits that passage of optical signals into, and out of, indoor unit 200 without significant interference or blockage by the material of the housing. In a further implementation, optical windows 420-1 and 420-2 each include a segment of optical fiber that extends through, and flush with, an outer surface of the housing of indoor unit 200.

Figures 5A, 5B:
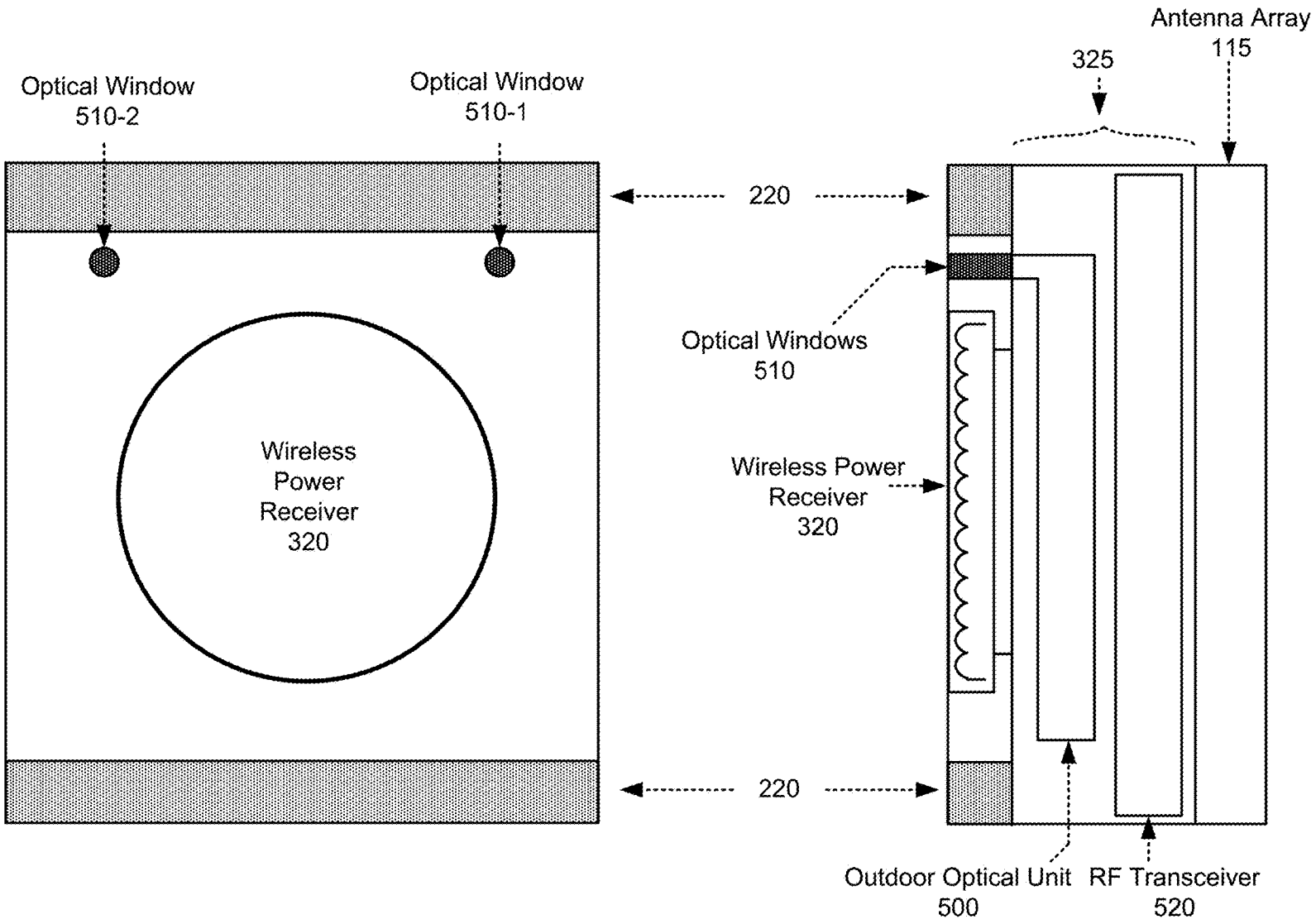
FIGS. 5A, 5B, and 5C depict a rear view, side view, and a front view of the outdoor unit of the window-mounted antenna unit.
Figure 5C:
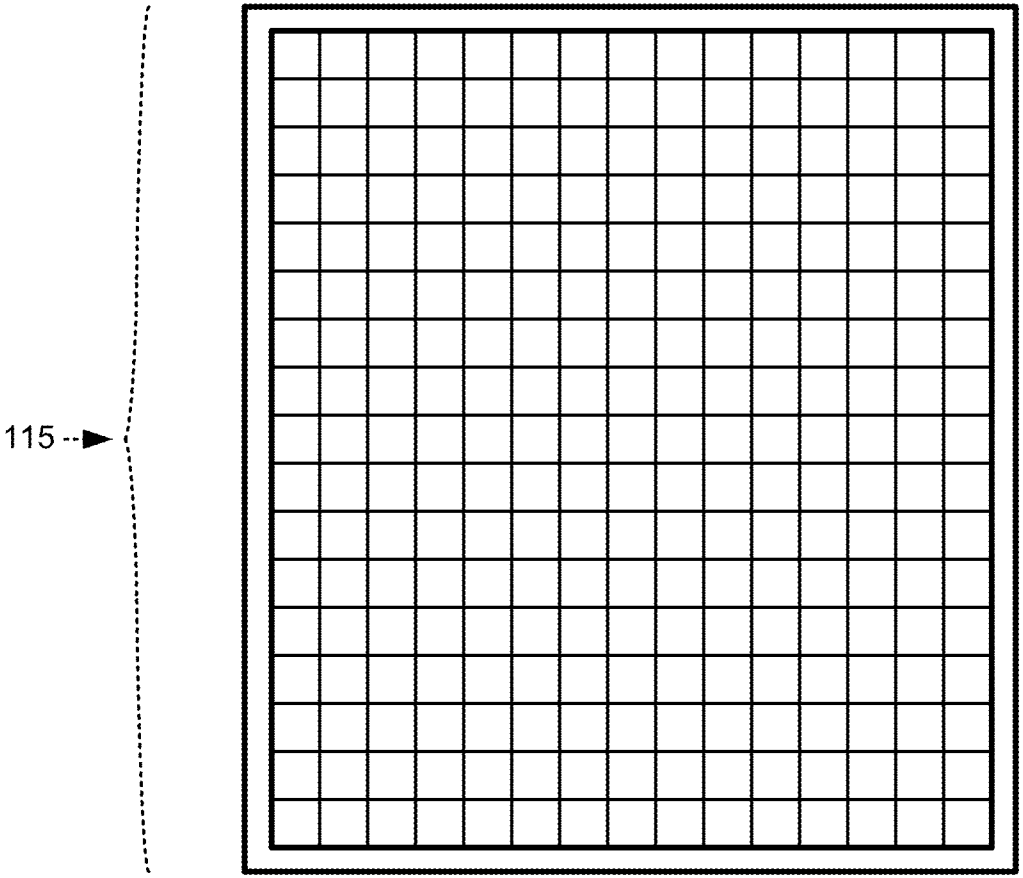

FIGS. 5A, 5B, and 5C depict a rear view, side view, and a front view, respectively, of outdoor unit 210 of window-mounted antenna unit 105. As shown in the rear view of FIG. 5A, wireless power receiver 320 may be disposed centrally within a face of antenna unit 105 such that a large surface area of wireless power receiver 320 faces the wireless power transmitter 310 of indoor unit 200 (not shown). Optical windows 510-1 and 510-2 each include an optical conduit (e.g., optically transmissive) from outdoor optical unit 500 through to the outer surface of the rear of outdoor unit 210 shown in FIG. 5A. Optical window 510-1 includes an optical conduit from outer surface of outdoor unit 210 to the optical data receiver (not shown) of outdoor optical unit 500. The optical data receiver (not shown) of outdoor optical unit 500, therefore, receives optical signals transmitted from a corresponding optical window (e.g., optical window 420-1) of indoor unit 200 through window 110 and optical window 510-1. Optical window 510-2 includes an optical conduit from the optical data transmitter (not shown) of outdoor optical unit 500 to the outer surface of outdoor unit 210. The optical data transmitter (not shown) of outdoor optical unit 500, therefore, transmits optical signals through optical window 510-2 and window 110 to a corresponding optical window (e.g., optical window 420-2) disposed within the indoor unit 200 (not shown). In one implementation, optical windows 510-1 and 510-2 each include translucent or transparent sections of the housing of outdoor unit 210. In another implementation, optical windows 510-1 and 510-2 each include a hole, or gap, in the housing of outdoor unit 210, such that the housing may be open to the exterior, which permits that passage of optical signals into, and out of, outdoor unit 210 without significant interference or blockage by the material of the housing. In another implementation, optical windows 510-1 and 510-2 each include a section of optical fiber that extends through, and flush with, an outer surface of the housing of outdoor unit 210.

Outdoor optical unit 500 of outdoor unit 210, as depicted in the side view of FIG. 5B, receives optical signals transmitted from indoor unit 200 through window 110 and a respective one of optical windows 510 (e.g., optical window 510-1 in FIG. 5A), converts the optical signals to electrical signals, and sends the electrical signals to RF transceiver 520 for transmission as RF signals via antenna array 115.

Antenna array 115 receives wireless RF signals and sends corresponding electrical signals to RF transceiver 520. RF transceiver 520 receives the electrical signals from antenna array 115, converts the electrical signals to corresponding digital signals, and sends the digital signals to outdoor optical unit 500. Outdoor optical unit 500 receives the digital signals from RF transceiver 520, converts the digital signals to optical signals, and transmits the optical signals via a respective one of the optical windows 510 (e.g., optical window 510-2 in FIG. 5A) through window 110 to indoor unit 200.

As shown in the front view of FIG. 5C, antenna array 115 of outdoor unit 210 may include an array of multiple antenna elements. In some implementations, the multiple antenna elements may be disposed behind a "beautification" radome that enhances the external look of outdoor unit 210 and also protects outdoor unit 210 from adverse environmental conditions (e.g., rain, hail, sleet, snow). In one implementation, antenna array 115 may include a phased array antenna.

Figure 6:
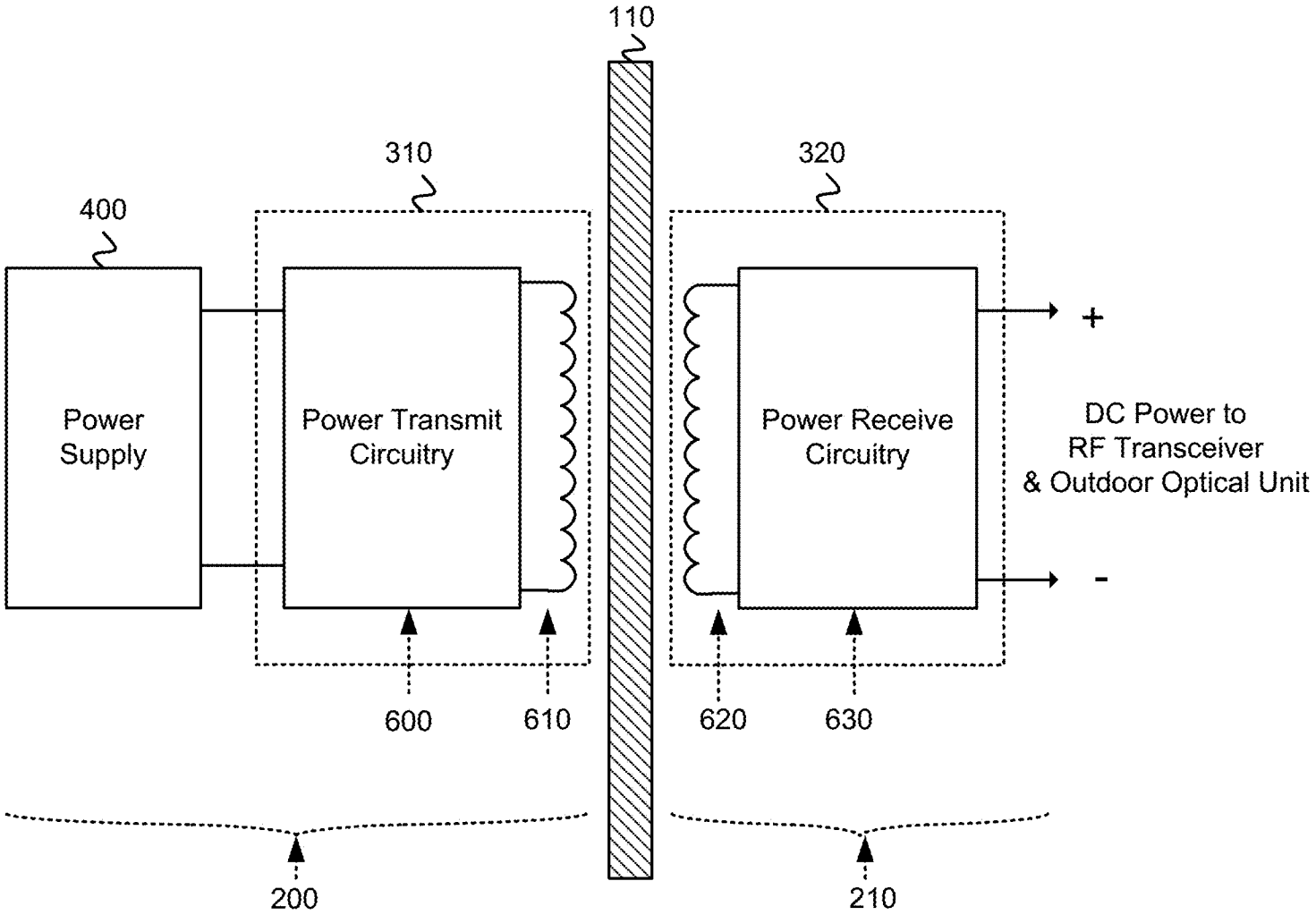
FIG. 6 depicts details of the components of the indoor unit and the outdoor unit, according to one exemplary implementation, involved in the wireless transfer of power from the indoor unit to the outdoor unit.

FIG. 6 depicts details of the components of indoor unit 200 and outdoor unit 210, according to one exemplary implementation, involved in the wireless transfer of power from indoor unit 200 to outdoor unit 210. Indoor unit 200 includes a power supply 400, and wireless power transmitter 310. As depicted, wireless power transmitter 310 further includes power transmit circuitry 600 and a power transmit coil 610. Outdoor unit 210 includes wireless power receiver 320 that further includes a power receive coil 620 and power receive circuitry 630.

Power supply 400 of indoor unit 200 receives input AC voltage from an external source and supplies the AC voltage to the power transmit circuitry 600. Power transmit circuitry 600 supplies the AC voltage to the power transmit coil 610 which, in turn, induces, wirelessly through window 110, a corresponding AC voltage upon power receive coil 620 of outdoor unit 210. Power transmit coil 610 and power receive coil 620 may be designed, using known techniques, to supply the appropriate AC voltage and current levels to power receive coil 620 based on the input AC voltage applied to power transmit coil 610. Power receive coil 620 supplies the induced AC voltage to power receive circuitry 630, which then converts the AC voltage to a direct current (DC) voltage using AC-to-DC conversion circuitry. Power receive circuitry 630 outputs the converted DC voltage to power the other components of outdoor unit 210 (e.g., to power outdoor optical unit 500 and RF transceiver 520).

Figure 7:
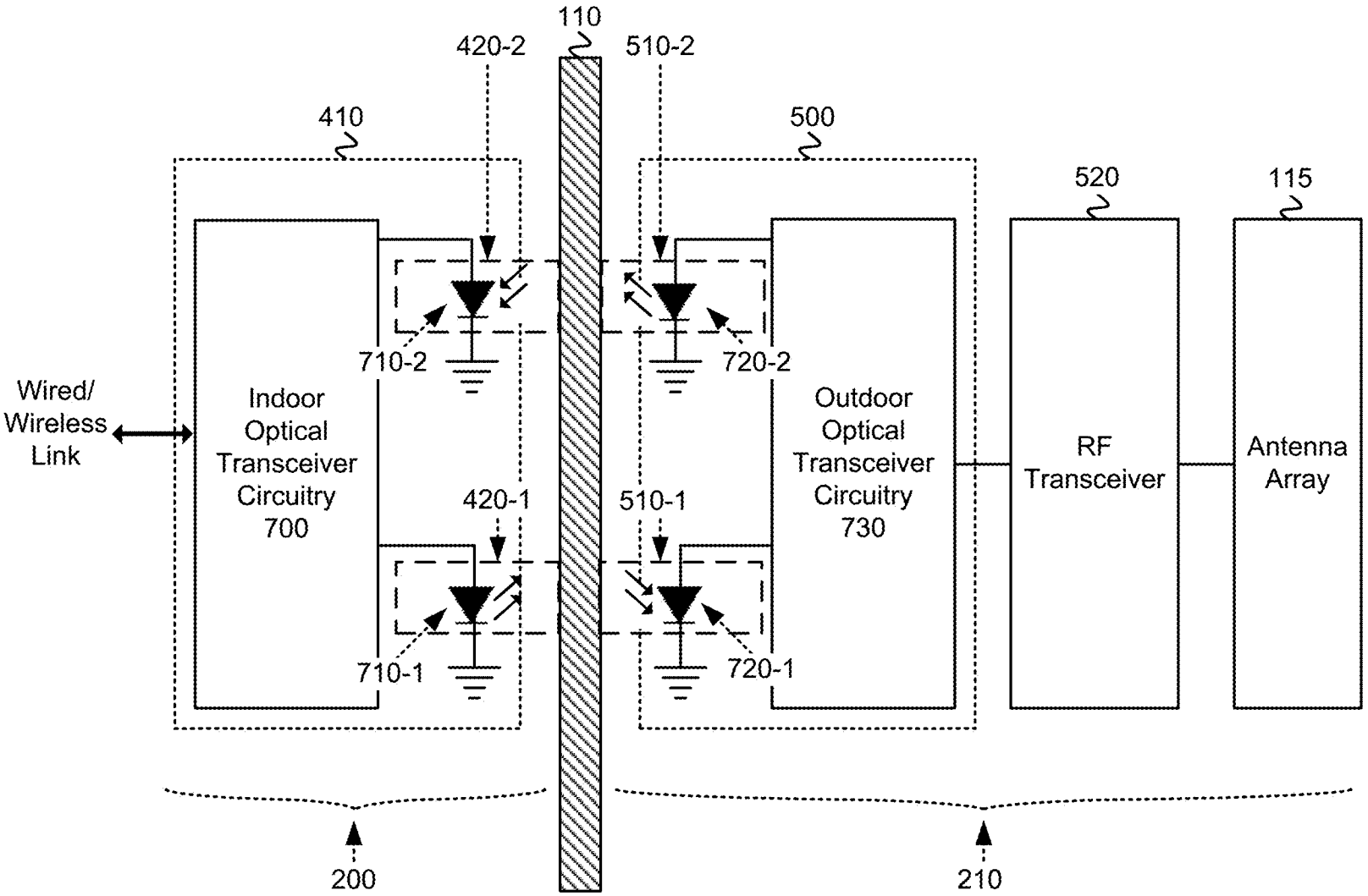
FIG. 7 depicts details of the components of the indoor unit and the outdoor unit, according to one exemplary implementation, that are involved in the optical transmission of data from the indoor unit to the outdoor unit, and from the outdoor unit to the indoor unit, through a building window.

FIG. 7 depicts details of the components of indoor unit 200 and outdoor unit 210, according to one exemplary implementation, that are involved in the optical transmission of data from indoor unit 200 to outdoor unit 210, and from outdoor unit 210 to indoor unit 200, through window 110. As shown, the indoor optical unit 410 of indoor unit 200 includes indoor optical transceiver circuitry 700, a light emitting diode (LED) 710-1, and a photodiode 720-2. The outdoor optical unit 500 of outdoor unit 210 includes photodiode 720-1, LED 720-2, and outdoor optical transceiver circuitry 730.

Indoor optical transceiver circuitry 700 includes circuitry that receives input digital signals via the wired or wireless link to router 140, or another node(s) or device(s), and transmits the digital signals, as corresponding optical signals (e.g., optical pulses), via LED 710-1 and optical window 420-1 through window 110 to photodiode 720-1 of outdoor unit 210. Photodiode 710-2 of indoor optical transceiver circuitry 700 receives optical signals transmitted by LED 720-2 of outdoor unit 210, through window 110 via optical window 420-2, converts the optical signals to corresponding electrical signals, and supplies the electrical signals to indoor optical transceiver circuitry 700. Indoor optical transceiver circuitry 700 transmits the electrical signals, as digital signals, via network cable 315 to, for example, router 140.

Antenna array 115 receives wireless RF signals, and supplies the RF signals as electrical signals to RF transceiver 520. RF transceiver 520 converts the received electrical signals to digital signals, and supplies the converted digital signals to outdoor optical transceiver circuitry 730. Outdoor optical transceiver circuitry 730 includes circuitry that receives input digital signals from RF transceiver 520, and transmits the digital signals, as corresponding optical signals (e.g., optical pulses), via LED 710-2 and optical window 510-2 through window 110 to photodiode 710-2 of indoor unit 210. Photodiode 720-1 of outdoor unit 210 receives optical signals transmitted by LED 720-1 of indoor unit 210, through window 110 via optical window 510-1, converts the optical signals to corresponding electrical signals, and supplies the electrical signals to outdoor optical transceiver circuitry 700. Outdoor optical transceiver circuitry 700 sends the electrical signals to RF transceiver 520, which transmits the electrical signals via antenna array 115.

The exemplary implementation of FIG. 7 depicts the use of LEDs 710-1 and 720-2 for transmitting optical signals through window 110. In other implementations, laser diodes, photo transmitters, or another type of signal source component/device, may alternatively be used. Additionally, FIG. 7 depicts the use of photodiodes 710-1 and 710-2 for receiving optical signals transmitted through window 110. In other implementations, phototransistors, photo receivers, or another type of signal reception component/device, may alternatively be used. Furthermore, in additional implementations, instead of the optical transmission of data through window 110, as depicted in FIG. 7, RF transmission, using lower frequencies for penetration of window 110, or B-field modulation, may alternatively be used to transfer data between indoor unit 200 and outdoor unit 210 through window 110.

The foregoing description of implementations provides illustration and description, but is not intended to be exhaustive or to limit the invention to the precise form disclosed. Modifications and variations are possible in light of the above teachings or may be acquired from practice of the invention. For example, exemplary embodiments have been described herein with respect to RF antenna assembly 105 utilizing mmWave cellular bands. However, RF antenna assembly 105 may alternatively employ other RF cellular bands, such as other bands that also suffer from attenuation transiting through thermal coated windows.

Certain features described above may be implemented as "logic" or a "unit" that performs one or more functions. This logic or unit may include hardware, such as one or more processors, microprocessors, application specific integrated circuits, or field programmable gate arrays, software, or a combination of hardware and software.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

To the extent the aforementioned embodiments collect, store or employ personal information provided by individuals, it should be understood that such information shall be used in accordance with all applicable laws concerning protection of personal information. Additionally, the collection, storage and use of such information may be subject to consent of the individual to such activity, for example, through well known "opt-in" or "opt-out" processes as may be appropriate for the situation and the type of information. Storage and use of personal information may be in an appropriately secure manner reflective of the type of information, for example, through various encryption and anonymization techniques for particularly sensitive information.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A radio frequency (RF) antenna system, comprising:
a first unit comprising:
a housing;
a first attachment component to secure the first unit to a first surface of a window, wherein the first attachment component is located on a surface of the first unit at a first side of the housing;
wireless power reception circuitry located at the first side of the housing;
an antenna located at a second side of the housing opposite the first side of the housing;
an RF transceiver, coupled to the antenna and a first optical mechanism, to receive, via the antenna, incoming RF signals, and convert the RF signals to first electrical signals; and
the first optical mechanism, coupled to the RF transceiver and located between the RF transceiver and the wireless power reception circuitry, comprising a first optical window and a second optical window that include optical conduits that extend from the first optical mechanism through the first side of the housing of the first unit to the surface of the first unit adjacent the wireless power reception circuitry, wherein the first optical mechanism is to transmit the first electrical signals as first optical signals through the first optical window and the first surface of the window, and wherein the first optical mechanism is to receive second optical signals through the first surface of the window and the second optical window.

2. The RF antenna system of claim 1, wherein the antenna comprises a phased array antenna or a waveguide planar antenna.

3. The RF antenna system of claim 1, wherein the first attachment component comprises one of adhesive, a suction cup, or a magnet.

4. The RF antenna system of claim 1, wherein the first optical mechanism comprises one of a laser diode, a photo transmitter, or a light emitting diode (LED).

5. The RF antenna system of claim 1, wherein the first optical window comprises a first segment of optical fiber through which the first optical mechanism transmits the first optical signals.

6. The RF antenna system of claim 1, further comprising:
a second unit comprising:
a second attachment component to secure the second unit to a second surface of the window;
a second optical mechanism to:
receive the first optical signals through the second surface of the window, wherein the second optical mechanism is aligned with the first optical mechanism of the first unit,
convert the first optical signals to first digital signals, and
transmit the first digital signals to a device within, or coupled to, the second unit.

7. The RF antenna system of claim 6, wherein the first attachment component and the second attachment component comprise at least one magnet.

8. The RF antenna system of claim 6, wherein the second unit further comprises:
wireless power transmission circuitry to wirelessly transfer power through the window to the first unit, and
wherein the wireless power reception circuitry receives the power wirelessly transferred through the window by the wireless power transmission circuitry of the second unit.

9. The RF antenna system of claim 7, wherein the wireless power transmission circuitry includes a first coil and wherein the wireless power reception circuitry comprises a second coil.

10. The RF antenna system of claim 6, wherein the second optical mechanism comprises one of a photodiode, a photoreceiver, or a phototransistor.

11. The RF antenna system of claim 6, wherein the first unit comprises an outdoor unit and the second unit comprises an indoor unit.

12. The RF antenna system of claim 6, wherein the second optical mechanism is further to:
receive incoming second electrical signals from the device, and
transmit the second electrical signals as the second optical signals through the second surface of the window to the first unit;
wherein the first optical mechanism is further to:
receive the second optical signals transmitted through the window,
convert the second optical signals to second electrical signals, and
wherein the RF transceiver is further configured to:
transmit, via the antenna, the second electrical signals as outgoing RF signals.

13. The RF antenna system of claim 6, wherein the first optical mechanism comprises a first optical transceiver and wherein the second optical mechanism comprises a second optical transceiver.

14. The RF antenna system of claim 6, wherein the device within, or coupled to, the second unit comprises a router or switch.

15. The RF antenna system of claim 12, wherein the device within, or coupled to, the second unit comprises a router or switch.

16. The RF antenna system of claim 1, wherein the RF antenna system operates as a micro-cell of a cellular network.

17. The RF antenna system of claim 1, wherein the first attachment component attaches, affixes, connects, couples, or clamps the first unit to, or braces the first unit against, the first surface of the window.

18. The RF antenna system of claim 1, wherein the antenna transmits and receives RF signals in the millimeter wave (mmWave) spectrum.

19. The RF antenna system of claim 6, wherein the second attachment component attaches, affixes, connects, couples, or clamps the second unit to, or braces the second unit against, the second surface of the window.

20. The RF antenna system of claim 6, wherein the device within, or coupled to, the second unit comprises a router and wherein the second unit further comprises:

a wireless transceiver for establishing a wireless Local Area Network (WLAN) or Personal Area Network (PAN) with the router for transmitting data to, and receiving data from, the router, including transmitting the first digital signals to the router via the WLAN or the PAN.

* * * * *